United States Patent [19]

Rothberg

[11] 4,224,986

[45] Sep. 30, 1980

[54] DIVERTER TOOL

[75] Inventor: Robert H. Rothberg, Houston, Tex.

[73] Assignee: Exxon Production Research Company, Houston, Tex.

[21] Appl. No.: 968,533

[22] Filed: Dec. 11, 1978

[51] Int. Cl.[2] ..... E21B 23/00

[52] U.S. Cl. ..... 166/117.5; 166/72

[58] Field of Search ..... 166/70, 117.5, 75 R, 166/75 A, 72, 175 UP

[56] References Cited

U.S. PATENT DOCUMENTS

| | | | |
|---|---|---|---|
| 2,994,335 | 8/1961 | Dudley | 166/117.5 X |
| 3,139,932 | 7/1964 | Johnson | 166/95 |
| 3,384,421 | 5/1968 | Flatt | 302/28 |
| 3,472,317 | 10/1969 | Fowler . | |
| 3,665,955 | 5/1972 | Conner | 166/117.5 X |
| 3,677,001 | 7/1972 | Childers | 60/51 |
| 3,777,812 | 12/1973 | Burkhardt | 166/0.6 |
| 3,866,628 | 2/1975 | Weber | 137/625.44 |
| 3,881,516 | 5/1975 | Childers et al. | 166/70 |
| 3,958,633 | 5/1976 | Britch et al. | 166/117.5 |
| 4,119,146 | 10/1978 | Taylor | 166/72 |

*Primary Examiner*—William F. Pate, III

*Attorney, Agent, or Firm*—Gary D. Lawson; Marc L. Delflache

[57] ABSTRACT

A divertor tool is disclosed for diverting a pump-down tool (PDT) along various branches of a pipeline. The diverter includes a flapper to redirect the PDT along an alternate conduit of a wye-section of the pipeline. The flapper is hydraulically operated by an actuation chamber at the lower end of the diverter. The entire diverter tool is capable of being installed in a side-pocket mandrel of the pipeline adjacent the wye-section using such standard oil field equipment as a kickover tool. The entire diverter is also easily removable for servicing using a standard kickover tool.

13 Claims, 8 Drawing Figures

DIVERTER TOOL

BACKGROUND OF THE INVENTION

1. Field of the Invention

The present invention relates to hydraulically operated diverter tools used in diverting pump-down oil tool equipment and, more particularly, relates to hydraulically operated diverter tools supported within a side-pocket mandrel of a pipeline installed and removed therefrom using standard oil field equipment.

2. Description of the Prior Art

Within the last few years, offshore oil and gas production has continued to expand into deeper water depths in attempts to satisfy the world oil demands. To handle the environmental constraints imposed by the increased depths more efficiently, a Subsea Production System (SPS) as disclosed in Burkhardt et al, U.S. Pat. No. 3,777,812, has been developed to produce oil and gas directly on the seabed. The SPS is designed to operate in a submerged mode on the seabed without the need of a large offshore production platform. As discussed in Burkhardt, the SPS includes a complicated network of production lines, gas injection lines, waterflood lines and through-the-flowline (TFL) maintenance or service lines (column 3, line 29 et seq.). The TFL service lines are used to introduce pump-down tools (PDT), also known as TFL tools, into the oil wells for maintenance and related activity associated with the completion of a well.

Many types of diverters employ a gate or flapper to deflect a TFL tool from a TFL service line into the production line of a well (see Weber et al, U.S. Pat. Nos. 3,866,628, Fowler, 3,472,317 and Johnson, 3,139,932). That section of pipe where the TFL service lines and production lines branch off is frequently termed a wye-section. The use of diverter tools with respect to the SPS is further discussed in Burkhardt at column 3, lines 17 et seq.

One type of TFL diverter which is remotely serviceable is described in Childers et al, U.S. Pat. No. 3,881,516. A portion of the hydraulically operated diverter disclosed therein is serviceable from outside the pipeline by means of a subsea manipulator such as that discussed by Burkhardt at column 4, line 24 et seq. Only the hydraulic operator assembly, however, is removable from the pipeline and, therefore, capable of being remotely replaced or repaired at the water surface. The diverter body and paddle are not removable. Another type of hydraulically operated TFL diverter known as a dual reciprocating diverter is discussed in a paper by Drouin and Fowler entitled "Diverters for TFL Tools" presented at the ASME Petroleum Mechanical Engineering Conference, Tulsa, Oklahoma, September, 1969. The diverter disclosed therein was improved upon by Childers' U.S. Pat. No. 3,881,516 (see Childers, Patent 3,881,516, column 1, lines 20–28).

An evaluation of the hydraulically operated diverters available in industry has shown that due to the repeated servicing requirements of not only the actual operating mechanism but also the flapper or paddle and the associated linkage which pivots the flapper, a need exists for an easily serviceable diverter which can be installed and retrieved directly from the maintenance line in its entirety using such standard down-hole oil field equipment as a kickover tool. In this manner, the need for an expensive subsea manipulator which operates outside the production lines to remotely remove the hydraulic operator of a diverter is minimized. Indeed, if the manipulator was used solely to replace the hydraulic operator of a diverter as disclosed in Childers' Patent 3,881,516, the need for the manipulator for this task would be entirely eliminated if the hydraulic operator was retrievable from inside the maintenance line using standard oil field equipment. The use of standard equipment for servicing the diverter is preferable since such tools are readily available and highly reliable.

SUMMARY OF THE INVENTION

The present invention is, therefore, directed to an improved hydraulically operated diverter adapted for installation and removal from a side-pocket mandrel of a pipeline adjacent to a wye-section using standard oil field pump-down equipment such as a kickover tool.

The diverter includes a flapper to deflect a pump-down tool (PDT) off its initial course along a first or principal conduit into a second conduit or diversionary branch of the wye-section. The diverter is adapted for installation within the side-pocket mandrel using such standard oil field equipment as a kickover tool. The diverter is easily retrieved from the side-pocket mandrel using the same kickover tool. The kickover tool may be propelled in a pump-down manner or by a wire-line operation. Due to the harsh operating conditions, a diverter once installed requires frequent servicing; therefore, a simple and efficient manner for installing and removing the diverter is provided for using readily accessible oil field equipment.

In accordance with the teachings of the present invention, the diverter includes a flapper and a base housing. The flapper is pivotally supported on the base housing which is adapted to sealably support the diverter within the side-pocket. The flapper is adapted for pivotal movement between a first position and a second position. In the first position the flapper is adjacent the base housing leaving the first conduit open thereby permitting a PDT to continue past the diverter. However, when the flapper is pivoted to the second position, an advancing PDT is prohibited from continuing on in the first conduit and is diverted into the second conduit upon striking the flapper. The flapper is connected to the base housing in an integral manner to facilitate servicing requirement.

In a modification of the invention, the flapper is pivoted by means of a hydraulic operator having a piston supported within the base housing. In the relaxed or first position, the flapper is retracted out of the path of a PDT, leaving the first or principal conduit open as discussed above. However, when hydraulically activated by fluid pressure, the piston advances within the base housing pivoting the flapper via a linkage assembly across the width of the first conduit. Thus, the PDT is diverted from the first conduit into the second conduit or diversionary branch of the wye-section. The hydraulic operator includes a spring which is mounted within the housing above the piston to return the flapper to the relaxed position when the hydraulic pressure is released. This in turn brings the flapper back to the first position permitting passage of the PDT along the first conduit. The spring is designed to return the piston and, therefore, the flapper to the retracted or first position, a fail-safe position, should a loss of high pressure occur or should the high pressure accidentally lock-in due to a pinched line or the like.

The present invention includes the flapper and the hydraulic operator connected in as unitary or integral manner. This facilitates the servicing requirements since the flapper, which is subject to damage due to the impact forces of the PDT during diversion, is easily repaired or replaced after the entire diverter is retrieved from the side-pocket mandrel with a kickover tool.

It is, therefore, a general object of the present invention to provide a hydraulically operated diverter tool which is installed and removed in its entirety for repair or replacement using standard oil field equipment readily available in its entirety and highly dependable.

BRIEF DESCRIPTION OF THE DRAWINGS

In order that the features of this invention may be better understood, a detailed description of the invention as illustrated in the attached drawings follows.

DETAILED DESCRIPTION OF THE INVENTION

Figure 1:
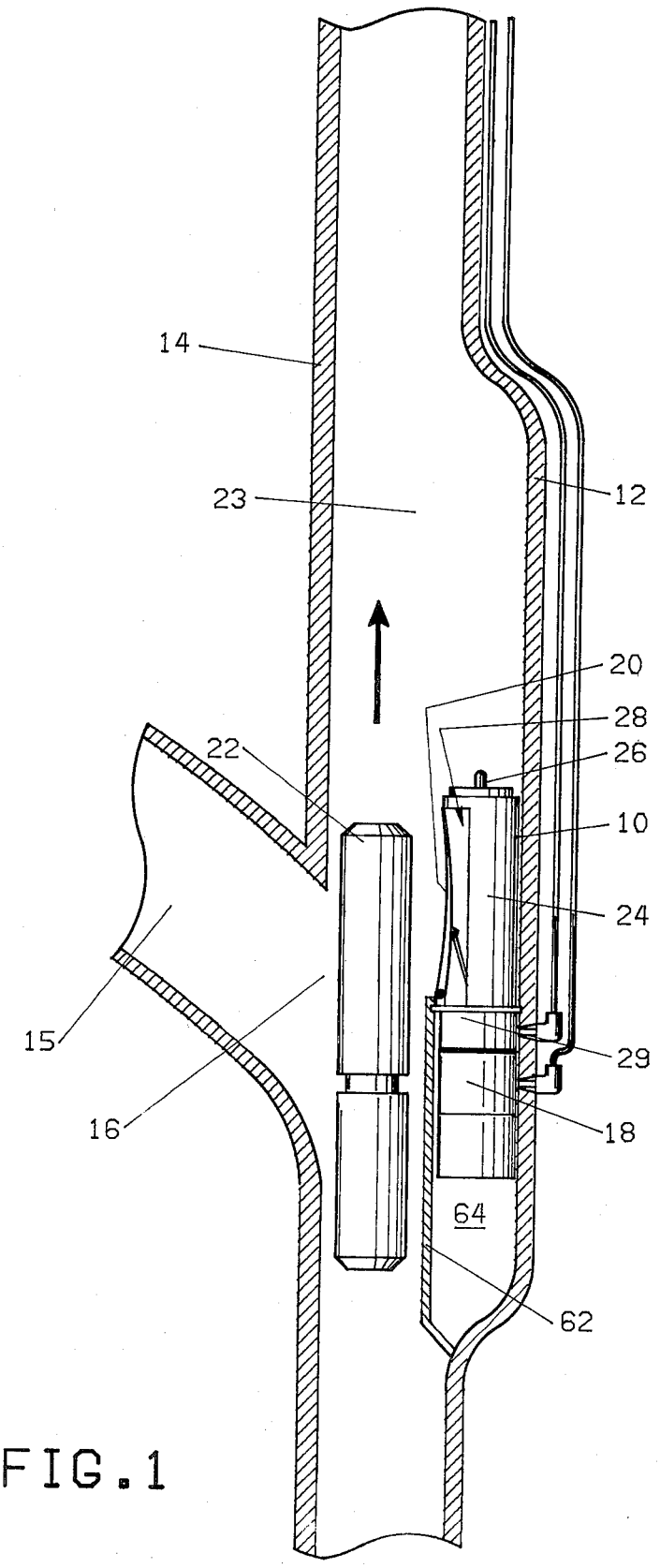
FIG. 1 is a cross-sectional view of a pipeline having a wye-section and a side-pocket mandrel. The present invention is shown supported within the side-pocket mandrel in a relaxed position permitting the passage of a PDT along a first or principal conduit.
Figure 3:
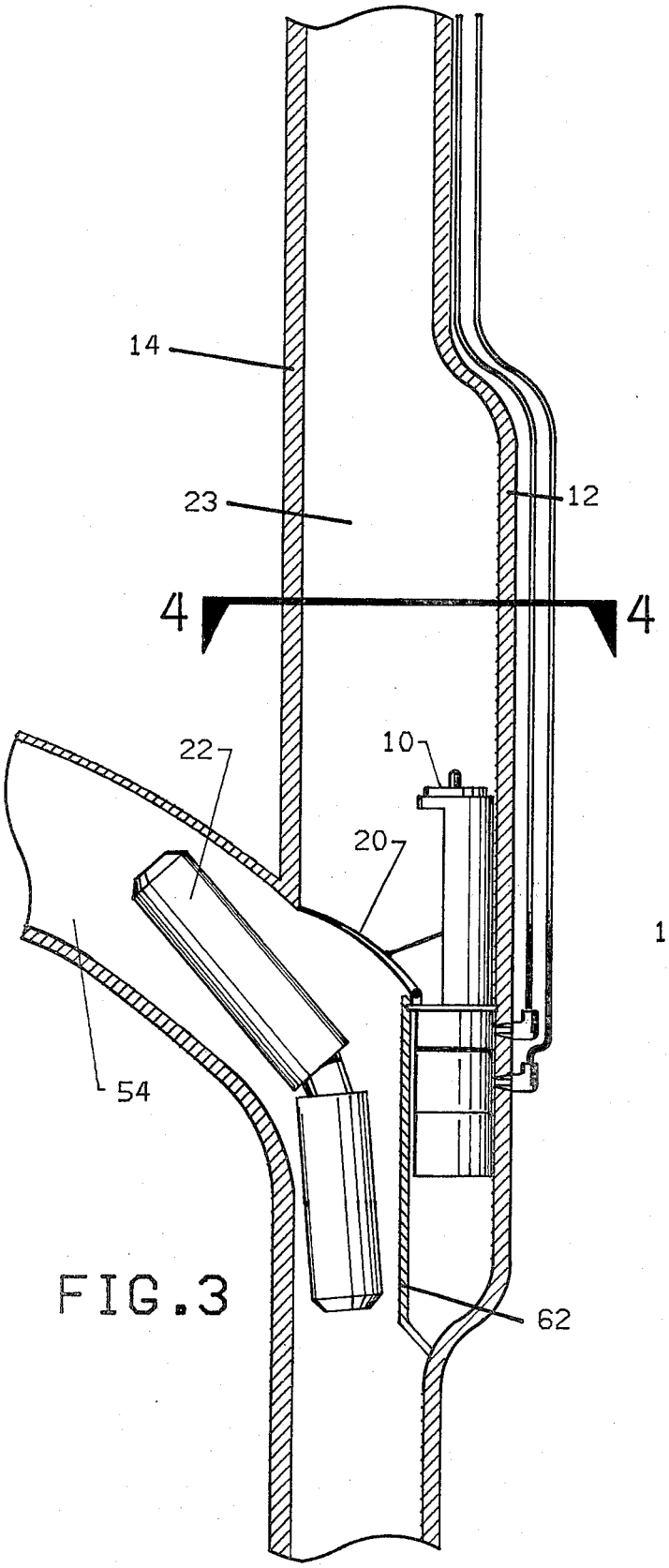
FIG. 3 is a cross-sectional view of the wye-section and side-pocket mandrel as seen in FIG. 1; however, the flapper is illustrated in an extended position diverting a PDT off its intended course into the second conduit or branch of the wye-section.
Figure 4:
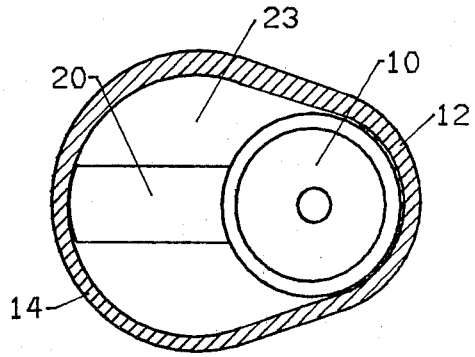
FIG. 4 is a cross-sectional view taken along line 4—4 of FIG. 3 showing the flapper in an extended or closed position.
Figure 5:
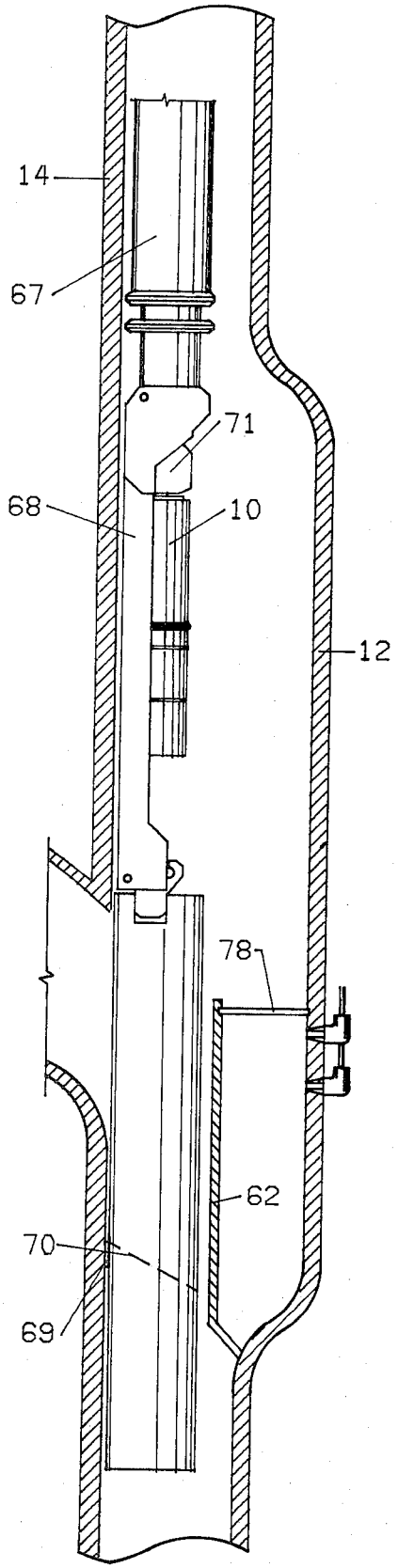
FIG. 5 is a cross-sectional view of the wye-section and side-pocket mandrel illustrating the attitude of the present invention with respect to a kickover tool during its descent to a predetermined location adjacent the side-pocket mandrel.

With reference to FIGS. 1–8, and with particular reference to FIG. 1, a diverter 10 is illustrated supported within a side-pocket mandrel 12 of a pipeline 14. The pipeline 14 is actually a TFL service or maintenance line which circumscribes an SPS as shown in FIG. 5 of Burkhardt U.S. Pat. No. 3,777,812. The TFL service line is used as an admission line for installing PDT tools into various drilling or producing wells 15. For clarity, the pipeline 14 is illustrated in a vertical attitude in FIG. 1; however, it may be oriented in any direction, e.g., horizontal, and still serve the purpose disclosed herein. Actually, there are generally several production lines along the length of a TFL service line as illustrated in FIG. 5 of Burhardt U.S. Pat. No. 3,777,812. However, for purposes of this detailed description only one branch (production line 15) is shown. The side-pocket 12 is strategically located adjacent a wye-section 16 which connects the pipeline 14 and the production line 15. The diverter 10 includes a base housing 18 and a flapper 20. The flapper 20 is pivotally connected to the upper end 29 of the housing 18. Preferably, the diverter 10 is cylindrical in shape.

As illustrated in FIG. 1, the flapper 20 is maintained in a retracted position permitting the passage of a PDT 22 along a first or principal conduit 23 (which is defined by the pipeline 14 or the TFL service line). A PDT 22 is commonly used in industry to perform various functions within the well such as setting and retrieving plugs, chokes, etc. Therefore, if there are several production lines along the length of a TFL service line each branching off at its respective wye-section, an operator can remotely admit a PDT into a particular production line to perform a specific function within that line. The PDT 22 is shown advancing from the bottom to the top of FIG. 1. This is the proper direction in order to effect a diversion into the production line 15 from the TFL service line with the diverter 10. However, it may be desirable to run a PDT in the opposite direction from that indicated in FIG. 1 (from the top to the bottom of the figure) if there is another production or branch line (not shown) further downstream which branches off the TFL service line in a clockwise direction rather than a counterclockwise direction as illustrated by the production line 15.

The diverter 10 includes an upper body 24 having a fishing neck 26 connected thereto for contact with a kickover tool 67 (see FIG. 5) such as that manufactured by the Otis Engineering Corporation of Dallas, Texas under the trade name "Tru-Guide Kickover Tool." The body 24 is attached to the base housing 18 and includes a recessed portion 28 along one side of the body 24. The recessed portion 28 provides a shelter for the flapper 20 when retracted to the relaxed or first position as shown in FIG. 1. In this manner, the flapper 20 is protected from damage during installation and removal of the diverter 10 within the pipeline 14. In addition, the recessed portion 28 protects the flapper 20 from contact with a PDT 22 passing through the first conduit 23.

Figure 2:
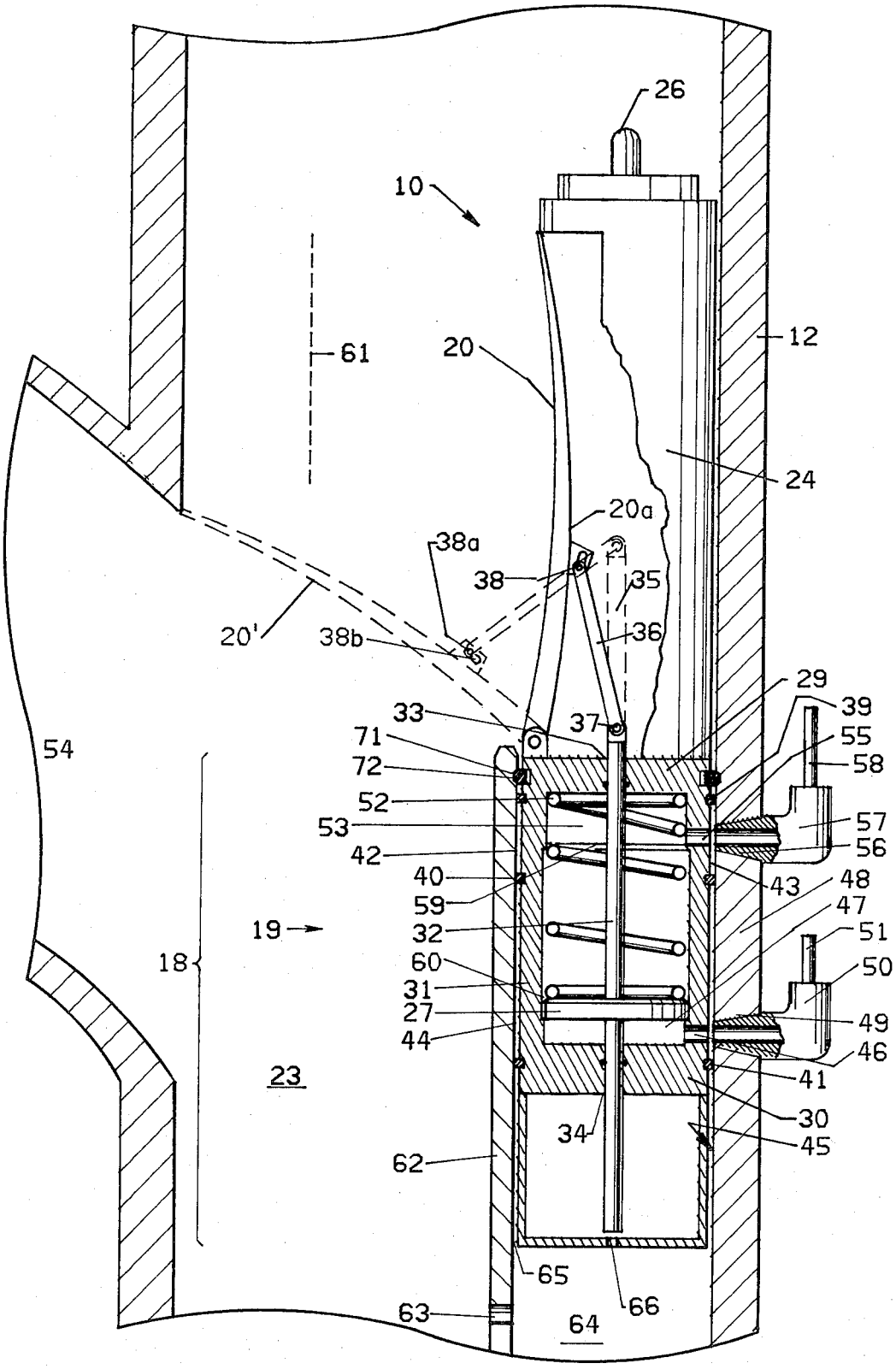
FIG. 2 is a detailed view of a hydraulic operator of the present invention as seen in FIG. 1 used to operate a flapper for diverting a PDT.

Referring to FIG. 2, a detailed view of the diverter 10 is shown with the flapper 20 maintained in a first position as indicated by the solid lines. Supported within the base housing 18 is a hydraulic actuation means 19 for pivoting the flapper 20. The base housing includes a first or upper end 29 and a second or lower end 30 connected by vertical, cylindrical walls 31. The actuation means 19 includes a piston 27 and a rod 32 which are supported within the housing 18. The rod 32 is fixed to the piston 27 permitting displacement of the rod and piston in an integral manner along the longitudinal axis of the housing 18. The rod 32 passes through apertures 33, 34 at the upper and lower end 29, 30 of the housing 18, respectively.

The actuation means 19 also includes a linkage assembly 35 having a load bearing member 36 pivotally connected at pivot point 37 to the top end of the rod 32 and at pivot point 38 to the back face **20*a* of the flapper 20. Pivot point 38 comprises a plate 38*a* attached to the back face 20*a*. A slot 38*b* is cut in the plate 38*a* to prevent any internal tension in member 36 as rod 32 advances upward due to the angular movement of flapper 20 and, therefore, the lateral displacement of point 38 with respect to rod 32**.

The housing also includes three packing elements 38, 40, 41 attached to the exterior surface 42 at predetermined intervals along the length of the exterior surface 42 of the housing 18. The packing elements 39, 40, 41 typically have a rectangular cross-section such as that manufactured by the Minnesota Rubber Company of Minneapolis, Minnesota under the trade name "Quad-Ring." The packing elements are capable of providing a watertight, oiltight seal thereby defining two pressurized annular chambers 43, 44 bounded by the packing elements, the exterior surface of the housing 18 and the interior surface 45 of the side-pocket mandrel 12. The wall 31 of the housing 18 includes an aperture 46 which permits open communication between the chamber 44 and a lower chamber 47 of the housing 18. The outside wall 48 of the side-pocket mandrel 12 includes a threaded aperture 49, an elbow fitting 50 and hydraulic tubing 51. The aperture 49 is adapted for the elbow fitting 50 while the tubing 51 connects the elbow fitting 50 to a remote control center (not shown). A return spring 52 is supported within an upper chamber 53 bounded by the piston 27 and the bottom surface of the upper end 29 of the housing 18.

The base housing 18 includes a second pressurized annular chamber 43 bounded by the packing elements 39, 40 as discussed above. An aperture 55, near the upper end 29 of the housing 18, provides open communication between the chamber 43 with the chamber 53. The side-pocket mandrel 12 also includes a second threaded aperture 56, a second elbow fitting 57 and hydraulic tubing 58. The elbow fitting 57 is secured within the threaded aperture 56 while the tubing 58 connects the elbow fitting 57 with a low pressure return sump (not shown) which is usually maintained at ambient pressure.

Whenever the hydraulic fluid within the tubing 51 and the chambers 44, 47 is pressurized by means of the control center such that the hydraulic pressure force within the chamber 47 acting against the bottom side of the piston 27 is more than the compressive force exerted by the spring 52 plus the hydrostatic head or pressure within chamber 53 acting against the top side of the piston, the piston advances upward (defined as a power stroke) pivoting the flapper 20 to an extended position as illustrated by the dashed lines 20'. In this manner, a PDT 22, as shown in FIG. 3, advancing along the first conduit 23 is deflected by the flapper 20 into a second conduit 54 (which is the production line 15 in FIG. 1). However, when the hydraulic pressure within the chamber 47 decreases, the spring 52 pushes the piston downward (defined as an exhaust stroke) retracting the flapper 20 to its relaxed or first position. In other words, the remote control center, which connects with the tubing 51 and eventually the pressurized chamber 47, provides the pressure necessary to overcome the compressive force of the spring 52 and the hydrostatic or pressure head across the top side of the piston 27 advancing the piston upward while the second elbow fitting 57 and hydraulic tubing 58 provides a return system which provides a means for dissipating the fluid compressed within the chamber 53 by the advancement of the piston 27. Thus, any pressure build-up within chamber 53 is released into the return system permitting the pivotal movement of the flapper from the first to the second position as illustrated by the dashed lines 20' in FIG. 2.

The vertical walls 31 include a beveled shoulder 59 which restricts the advancement of the piston 27 and thereby limits the size of the chamber 47. The piston 27 also includes a chamfer 60 at its upper edge. During the advancement of the piston 27 upward, thereby rotating the flapper to the second position, the chamfer 60 eventually seats against the shoulder 59 terminating the power stroke. A clearance is provided between the outside edge of the piston 27 and the inside surface of walls 31. In this manner, slight leakage is permitted past the piston during its advancement upward or during the power stroke. Alternatively, the piston may include a series of elastomeric seal rings (not shown) attached around its peripheral edge which would control the amount of fluid leakage between the chambers 47 and 53.

Once the chamfer 60 contacts the shoulder 59 the power stroke ends. The contact is a metal-to-metal seal which is substantially fluid tight. However, a very slight predetermined amount of fluid is permitted to leak past the metal-to-metal seal to provide a fail-safe condition. In other words, should the hydraulic tubing 51 be pinched prohibiting the release of high pressure within chamber 47 after the piston 27 has completed the power stroke and seated against shoulder 59 with the flapper 20 in the extended or second position, the pressure within chambers 47 and 53 is permitted to gradually equalize by means of the predetermined leakage rate past the seal. For example, on completion of the power stroke wherein the actuating or high pressure in the chamber 47 is 3000 psig and the return line pressure in the chamber 53 is 100 psig, a leakage of 1% to 2% of the chamber's 47 volume past the metal-to-metal seal will permit the pressure to equalize in both chambers 47 and 53 and allow the spring 52 to return the flapper 20 to the first position. Childers, U.S. Pat. No. 3,677,001, further discusses the use of predetermined fluid leakage rates across a piston and metal-to-metal seals in hydraulic systems. Once the pressure across the piston equalizes, the spring 52 gradually pushes the piston downward over a period of time returning the flapper to the retracted or first position. Thus, a fail-safe condition is provided for during an emergency since the flapper will return to its retracted position preventing obstruction of the first conduit 23.

Release of pressure via leakage of fluid from chamber 53 through aperture 55 and into the return system is also permitted preventing a premature pressure equalization on both sides of piston 27 during the power stroke. Pressure build-up occurs in the upper chamber 53 during the power stroke due to the decrease in the size of the chamber 53 resulting from the advancement of the piston. The return system also provides a flushing action for constantly circulating the fluid within the chamber 53. This prevents the accumulation of debris which would otherwise impede the flow characteristics of the fluid past the chamfer 60 and piston 27 once seated thereby impairing the fail-safe condition noted above and causing a stagnant fluid condition advancing the corrosion of metal parts.

The force exerted by a PDT striking the flapper in the extended or second position is frequently on the order of 2,000–5,000 lbs. To prevent the PDT from actually bending or deflecting the flapper back to its retracted position, the length of the load bearing member 36 and the location of the second pivot point 38 are chosen so as to provide an "over-the-center" linkage. In other words, the member 36 is sized such that the member can exert a vertical force component parallel to the axis 61 directly opposite the force component exerted by the PDT striking the flapper when extended to the second position. The axis 61 is preferably parallel to the longitudinal axis of the pipeline 14.

Frequently, the internal pressure within the pipeline 14 or principal conduit 23 is 5,000–10,000 psi. Therefore, the advancement of the piston 27 and rod 32 during the power stroke may be impeded by the internal pressure force acting against the cross-sectional area of the rod 32 at the upper end 29 of the housing 18. To compensate for this pressure interference, a guide rail 62, which is part of the side-pocket mandrel 12 and which assists in stabilizing the diverter 10 within the mandrel 12, includes an aperture 63 to provide open communication between the internal pressure within the principal conduit 23 and a chamber 64 defined by the packing element 41 and the lower portion of side-pocket mandrel 12. The lower end 30 of housing 18 is protected by a cover housing 65 having an aperture 66. In this manner, the internal pressure within the principal conduit 23 exerts an equal and opposite pressure on the cross-sectional area of the rod 32 exposed at the bottom end of the housing 18 thereby eliminating the pressure interference. The cover housing 65 also protects the end of the rod 32 during installation and removal of the diverter 10.

As shown in FIG. 3, the flapper 20 is illustrated in an extended position resulting in the diversion of a PDT 22 into the second conduit 54. As discussed above, the second conduit 54 would typically represent a branch from the TFL service line into the production line of an SPS leading down to a well. Normally, the flapper 20 is maintained in a retracted position as shown in FIG. 1 since the hydraulic pressure within the chamber 47 is less than the compressive force of the spring 52. As noted earlier, this provides a fail-safe position preventing the accidental obstruction of the first conduit 23 and, therefore, impeding service of other wells downstream of the diverter in question.

FIG. 4 is a cross-sectional view of the diverter 10 positioned within the side-pocket mandrel 12 showing the flapper 20 extended across the width of the first conduit 23. Since the flapper is used primarily to divert a PDT, it is not necessary that the shape of the flapper conform to the cross-sectional shape of the conduit 23. Rather, any shape such as the rectangular configuration illustrated in FIG. 4 would serve the intended purpose. Indeed, it would be difficult to install the diverter 10 if the flapper were the same width as the interior diameter of the pipeline 14. It is necessary that the flapper, when extended, span across the entire width of the first conduit to ensure that the PDT is accurately and rapidly diverted into the second conduit 54.

Figure 6:
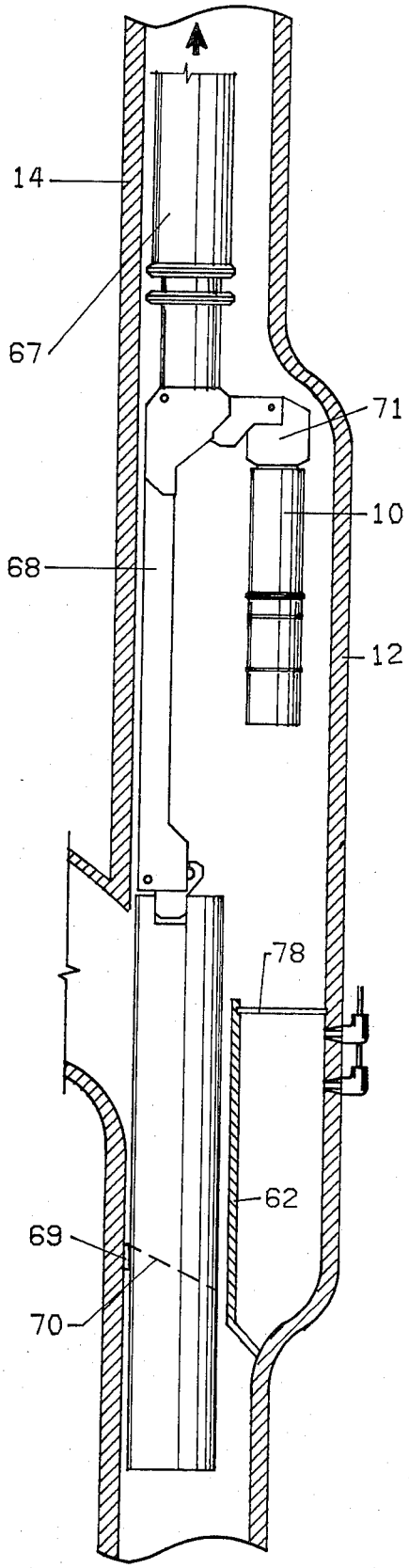
FIG. 6 is a cross-sectional view of the wye-branch and side-pocket mandrel as shown in FIG. 1; however, herein the installation of the present invention within the side-pocket mandrel by means of the kickover tool is illustrated.

With reference to FIGS. 5 and 6, a kickover tool 67, such as that manufactured by the Otis Engineering Corporation, is shown supporting a diverter 10 adjacent the side-pocket mandrel 12. The diverter 10 is supported within a carrier tray 68 during the descent of the tool 67. The kickover tool is initially oriented with respect to the side-pocket mandrel by means of a spring operated alignment key 69 and muleshoe 70. The alignment key 69 tracks the muleshoe 70 as the kickover tool 67 is lifted thereby orienting the carrier tray 68 with respect to the side-pocket mandrel 12. The kickover tool 67 is then secured in place at the top of the muleshoe by the alignment key. In FIGS. 5 and 6, the alignment key 69 is illustrated at the top of the muleshoe 70. In this orientation, the alignment key cannot advance further along the muleshoe, and the diverter 10 is, therefore, properly aligned with respect to the side-pocket mandrel 12 for insertion. Tension is then applied to the kickover tool (indicated by the arrow in FIG. 6) as it is held in place by the alignment key shearing a ring (not shown) at the upper part of the kickover tool 67 and permitting a pivot arm 71 to spring the diverter 10 outward as shown in FIG. 6. Thereafter, the tension force is released allowing the kickover tool 67 and, therefore, the diverter 10 to descend. In this manner, the diverter is lowered into the side-pocket mandrel 12 in an integral manner. Since the use of spring-activitated alignment keys, muleshoes and kickover tools are well known in the art, no additional discussion outside of the foregoing brief explanation is believed necessary.

Figure 7:
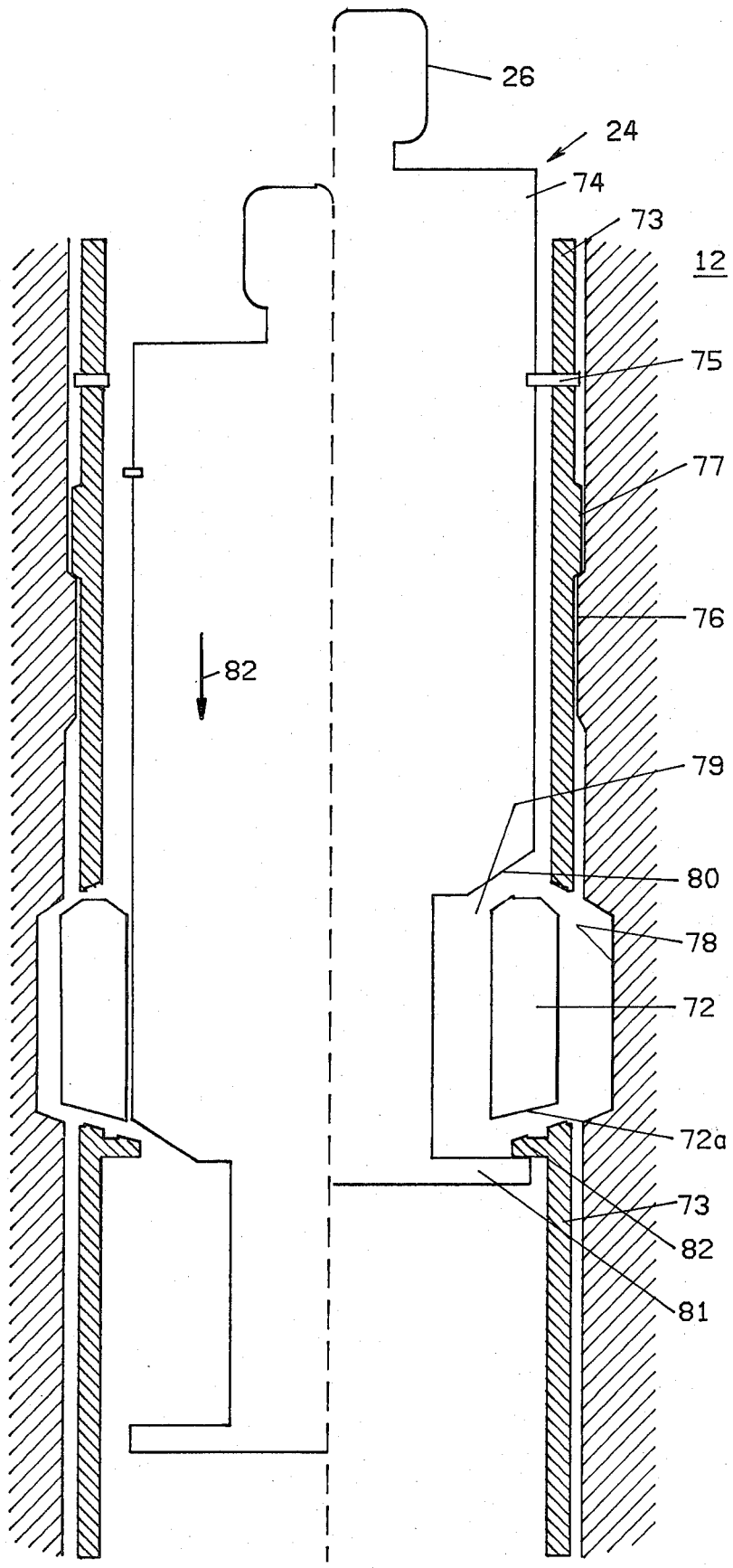
FIG. 7 is a two-part cross-sectional view of the upper body section of the diverter showing a series of concentric sleeves used to engage and disengage a locking ring which secures the diverter within the side-pocket mandrel.
Figure 8:
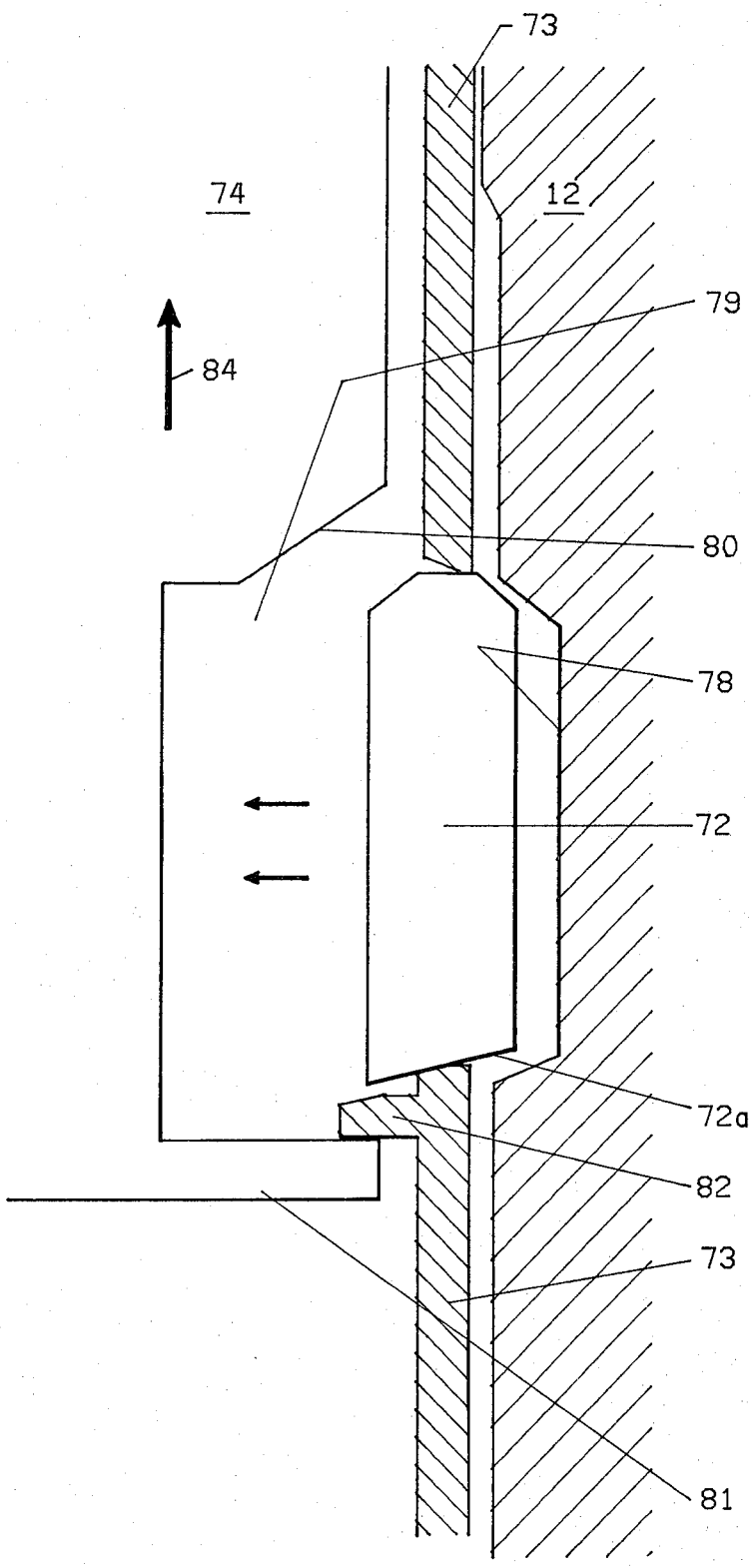
FIG. 8 is a detail view of the dogs in the upper body section of the diverter taken from FIG. 7 during the operation.

With reference to FIG. 7, the diverter 10 includes the upper body 24 having a series of locking dogs 72, concentric sleeves 73, 74 and shear pins 75. For simplicity, the side-pocket mandrel 12 in FIG. 2 was shown to have a smooth interior surface. However, frequently the mandrel 12 and diverter 10 include a "no-go" which is merely a mechanical means of prohibiting one object from advancing within a second object. Referring back to FIG. 7, the mandrel 12 includes a protruding ledge or shoulder 76 which decreases the inside diameter of the mandrel 12. The outer sleeve 73 also includes a ledge 77 which protrudes a sufficient distance to contact shoulder 76 upon insertion of the diverter 10 within the mandrel 12. The ledge 77 is positioned near the top end of the upper body 24 to ensure that the entire diverter is within the mandrel before contacting the shoulder 76. The mandrel 12 also includes a groove 78 which is located a predetermined distance below the shoulder 76 such that the dogs 72 are directly opposite the groove 78 once the ledge 77 contacts the shoulder 76. Initially, each dog 72 is housed within the inner sleeve 74 in a recessed region 79 having a bevelled edge 80. The dogs 72 are used to secure the diverter 10 within the side-pocketmandrel 12. The inner sleeve 74 includes a set of pullout stops 81 at the base of the sleeve. The outer sleeve 73 also includes a set of pullout stops 82 mounted at its base and positioned above the pullout stops 81. The pullout stops 82 extends past the pullout stop 81 to effect the retrieval operation discussed below.

The following explanation is well known in the art as one method of securing oil field equipment in a side-pocket mandrel. Yet for purposes of enablement, Applicant will describe in simpified terms the operation of the locking dogs 72 in combination with the concentric sleeves 73, 74 for securing the diverter within the mandrel. Applicant recognizes, however, that this is merely one of many possible methods which may be employed. The diverter is initially oriented and lowered into the mandrel by means of a kickover tool as discussed above. The right-side view of FIG. 7 illustrates a first installed position wherein initial contact between ledge 77 and shoulder 76 occurs before the dogs 72 are extended outward. A compressive force is then exerted on the tool 67 via the fishing neck 26 shearing the pins 75 and moving the inner sleeve 74 relative to the outer sleeve 73 as indicated by the arrow 82. In this manner, each dog 72 is advanced outward by means of the recessed lip 80 which strikes the dog 72 and thereby engageably advances the dog 72 into the groove 78 as seen in the left-side view of FIG. 7. Once the diverter 10 is securely locked in position by the advancement of the sleeve 74 behind each dog 72, the packing elements 39, 40, 41, (see FIG. 2) which are strategically located above and below the apertures 46, 55, provide the sealed annular chambers for the hydraulic pressurization of the interior chamber 47 as discussed above.

The diverter is removed from the side-pocket mandrel using the kickover tool which initially orients itself by means of the alignment key and muleshoe as explained above and, thereafter, attaches onto the fishing neck 26 by means of the pivot arm 71. Tension is applied and the inner sleeve 74 is advanced upward as illustrated by the arrow 84 in FIG. 8 until the pullout stops 81 contact the pullout stops 82. The locking dogs 72 are retracted by advancing the sleeve 74 upward. Each dog 72 includes a bevelled side 72*a* which permits the mechanically retraction of the dog 72 into the recessed region 79 by friction force once the pullout stops 81 and 82 contact and the inner and outer sleeves 74, 43 are moving in unison.

Therefore, in accordance with the teachings of the present invention, a diverter tool is disclosed and claimed which is capable of being installed and removed from a side-pocket mandrel adjacent a wye-section in an integral manner. The diverter is basically of unitary construction in that it is one object capable of being installed and removed from a side-pocket mandrel in its entirety by means of such standard oil field equipment as a kickover tool.

The foregoing discussion has been described in terms of a particular embodiment. Various modifications and alterations will be apparent to those skilled in the art in view of this disclosure. It is, therefore, Applicant's intention to cover all such equivalent modifications and variations which fall within the spirit and scope of this invention.

What I claim is:

1. An apparatus for diverting pump-down tools along one of two conduits at a wye-section of a pipeline, said apparatus comprises:

a base housing having an upper and lower end and adapted to be sealably supported within a side-pocket mandrel of the pipeline adjacent the wye-section;

a flapper connected to said housing and adapted for pivotal movement across the first conduit of the wye-section; and means for pivoting said flapper between a first position wherein said flapper is retracted adjacent said housing leaving the first conduit open permitting passage of the pump-down tool therethrough and a second position wherein said flapper is pivoted across the width of the first conduit so as to deflect the pump-down tool into the second conduit of the wye-section upon striking the flapper, said pivoting means is supported within said housing such that said housing and said flapper are capable of being removed in an integral manner from the side-pocket mandrel for servicing.

2. The apparatus according to claim 1 wherein said pivoting means includes:

a piston supported within said base housing defining an upper and lower chamber within said base housing;

a rod connected to said piston and extending through apertures at the upper and lower ends of said housing thereby supporting said piston;

a linkage assembly connected at one end to said rod passing through the top end of said housing and connected at the other end to said flapper; and a pressure means to operably advance said piston within said housing such that said flapper is pivotably rotated from said first position to said second position.

3. The apparatus according to claim 2 wherein said pivoting means further includes a biasing means supported within said base housing for advancing said piston opposite said operable advance of said pressure means thereby biasing said flapper toward said first position.

4. An apparatus for diverting pump-down tools along one of two conduits at a wye-section of a pipeline, said apparatus comprises:

a base housing having an upper and lower end and adapted to be sealably supported within a side-pocket mandrel of the pipeline adjacent the wye-section;

a flapper connected to said housing and adapted for pivotal movement across the first conduit of the wye-section;

means for pivoting said flapper between a first position wherein said flapper is retracted adjacent said housing leaving the first conduit open permitting passage of the pump-down tool therethrough and a second position wherein said flapper is pivoted across the width of the first conduit so as to divert the pump-down tool into the second conduit of the wye-section, said pivoting means is supported within said housing such that said housing and said flapper are capable of being removed in an integral manner from the side-pocket mandrel for servicing, said pivoting means includes:

a piston supported within said base housing defining an upper and lower chamber within said base housing;

a rod connected to said piston and extending through apertures at the upper and lower ends of said housing thereby supporting said piston;

a linkage assembly connected at one end to said rod passing through the top end of said housing and connected at the other end to said flapper;

a pressure means to operably advance said piston within said housing such that said flapper is pivotably rotated from said first position to said second position; and a biasing means supported within said base housing for advancing said piston opposite said operable advance of said pressure means thereby biasing said flapper toward said first position; and means for equalizing the pressure between said upper and lower chambers once said flapper has been extended to said second position so as to permit said biasing means to gradually advance said piston toward the bottom end of said housing and return said flapper to said first position.

5. The apparatus according to claim 4 wherein said apparatus further comprises means for releasing pressure build-up within said upper chamber as said pressure means operably advances said piston reducing the size of said upper chamber and increasing the size of said lower chamber.

6. An apparatus for diverting pump-down tools along one of two conduits at a wye-section of a pipeline, said apparatus comprises:

a base housing having an upper and lower end and adapted to be sealably supported within a side-pocket mandrel of the pipeline adjacent the wye-section;

a flapper connected to said housing and adapted for pivotal movement across the first conduit of the wye-section;

means for pivoting said flapper between a first position wherein said flapper is retracted adjacent said housing leaving the first conduit open permitting passage of the pump-down tool therethrough and a second position wherein said flapper is pivoted across the width of the first conduit so as to divert the pump-down tool into the second conduit of the wye-section, said pivoting means is supported within said housing such that said housing and said flapper are capable of being removed in an integral manner from the side-pocket mandrel for servicing, said pivoting means includes:

a piston supported within said base housing defining an upper and lower chamber within said base housing;

a rod connected to said piston and extending through apertures at the upper and lower ends of said housing thereby supporting said piston;

a linkage assembly connected at one end to said rod passing through the top end of said housing and connected at the other end to said flapper;

a pressure means to operably advance said piston within said housing such that said flapper is pivotably rotated from said first position to said second position; and a biasing means supported within said base housing for advancing said piston opposite said operable advance of said pressure means thereby biasing said flapper toward said first position; and means for compensating for an internal pressure within the pipeline acting against said rod extending through said aperture at the upper end of said housing as said piston and rod are advanced by said pressure means wherein said internal pressure is permitted to act against said rod extending through the lower end of said housing so that the advance of said piston by said pressure means is not inhibited.

7. The apparatus according to claim 6 where said apparatus further comprises locking means for securing said housing within the side-pocket mandrel.

8. The apparatus according to claim 6 wherein said apparatus further comprises an upper body attached to said base housing having a recessed portion so as to protect said flapper when said flapper is retracted in said first position permitting the installation and removal of said apparatus without damage to said flapper.

9. The apparatus according to claim 5 wherein said apparatus further comprises:

at least three packing elements spaced at predetermined intervals along the exterior surface of said base housing and capable of forming first and second sealable annular chambers bounded by said packing elements, said exterior surface of said base housing and the interior of said side-pocket mandrel wherein said first annular chamber is proximate with said lower end and said second annular chamber is proximate with said upper end; and said housing includes at least one aperture in the wall of said housing between two of said packing elements proximate the lower end of said housing providing open communication between said first annular chamber and the lower chamber of said housing permitting said pressure means to introduce pressure into said first annular chamber and through said aperture to advance said piston and thereby pivot said flapper to said second position.

10. The apparatus according to claim 9 wherein said apparatus further comprises:

said housing includes at least one aperture in the wall of said housing between two of said packing elements proximate the upper end of said housing providing open communication between said second annular chamber and the upper chamber of said housing permitting said pressure releasing means to release pressure from said upper chamber through said aperture and into said second annular chamber; and said pressure releasing means includes an aperature in the side-pocket mandrel providing open communication between said second annular chamber and the exterior of the pipeline permitting further release of pressure from said second annular chamber to the exterior of the pipeline.

11. An apparatus for diverting a pump-down tool at a wye-section of a pipeline having a first and second conduit, said apparatus comprises:

a base housing adapted to be supported within a side-pocket mandrel of the pipeline;

a flapper connected to said housing and adapted for pivotal movement across the first conduit of the wye-section;

means for pivoting said flapper from a first position to a second position so as to divert the pump-down tool away from the first conduit of the wye-section into the second conduit of the wye-section, said pivoting means includes:

a piston supported within said base housing and displaced by hydraulic pressure, a rod connected to said piston and extending through the top and bottom of said housing thereby supporting said piston, and a linkage assembly connected at one end to said rod passing through the top of said housing and connected at the other end to said flapper so as to pivot said flapper when across said first conduit wherein said linkage is attached at said other end to said flapper over center so as to reinforce said flapper when extended to said second position against the deflecting forces exerted by the pump-down tool; and means for compensating for an internal pressure acting against said rod as said piston is advanced forward by the hydraulic pressure eliminating any interference which said internal pressure may have on said pivoting means.

12. An apparatus for diverting a pump-down tool into one of two conduits of a wye-section of a pipeline having a side-pocket mandrel adapted to support said apparatus adjacent the wye-section such that said apparatus is capable of being installed and removed from the side-pocket mandrel by a kickover tool, said apparatus comprises:

a base housing capable of being supported within the side pocket mandrel;

a flapper pivotably connected to said housing and adapted for movement across a first conduit of the wye-section such that said flapper is capable of prohibiting the passage of the advancing pump-down tool into the first conduit and deflecting the pump-down tool into a second conduit of the wye-section when said flapper is pivotably rotated to an extended position, and said flapper permits passage of the pump-down tool into the first conduit when said flapper is retracted to a relaxed position adjacent said housing; and an upper body attached to said base housing having a recessed portion for protecting said flapper during installation and removal of said diverter and during passage of the pump-down tool when said flapper is retracted, said diverter tool is of unitary construction permitting removal of said entire diverter by means of a kickover tool.

13. An apparatus for diverting pump-down tools along one of two conduits at a wye-section of a pipeline, said apparatus comprises:

a base housing having an upper and lower end and adapted to be sealably supported within a side-pocket mandrel of the pipeline;

a flapper connected to said housing and adapted for pivotal movement across the first conduit of the wye-section;

means for pivoting said flapper between a first position wherein said flapper is retracted adjacent said housing leaving the first conduit open, permitting passage of the pump-down tool and a second position wherein said flapper is pivoted across the width of the first conduit so as to divert the pump-down tool into the second conduit of the wye-section;

hydraulically operable pressure means for engagement with said pivoting means such that said flapper is pivotally rotated from said first position to said second position;

biasing means for operably maintaining said flapper in said first position against the force exerted by said hydraulically operable pressure means attempting to pivot said flapper to said second position;

means for equilizing the high pressure developed by said hydraulically operable pressure means to pivot said flapper permitting said biasing means to return said flapper to said first position;

an upper body attached to said base housing having a recessed portion so as to protect said flapper when said flapper is retracted in said first position permitting the installation and removal of said apparatus without damage to said flapper; and said pivoting means, biasing means and equalizing means are supported within said base housing such that said upper body, base housing and flapper are adapted to be jointly removed from the side-pocket mandrel in a unitary manner.

* * * * *